United States Patent [19]

Dröscher et al.

[11] 4,261,617

[45] Apr. 14, 1981

[54] METHOD OF CONTROLLING THE WORKING MOTION OF A CUTTING TOOL OF A TUNNEL-DRIVING MACHINE OVER THE BREAST, AND APPARATUS FOR CARRYING OUT THE METHOD

[75] Inventors: Bernhard Dröscher; Alfred Zitz, both of Zeltweg, Austria

[73] Assignee: Vereinigte Osterreichische Eisen-und Stahlwerke - Alpine Montan Aktiengesellschaft, Vienna, Austria

[21] Appl. No.: 5,822

[22] Filed: Jan. 23, 1979

[30] Foreign Application Priority Data

Feb. 15, 1978 [AT] Austria ..... 1099/78

[51] Int. Cl.[3] ..... E21C 35/24

[52] U.S. Cl. ..... 299/1; 175/45

[58] Field of Search ..... 175/45; 299/1, 30

[56] References Cited

U.S. PATENT DOCUMENTS

| | | | |
|---|---|---|---|
| 3,853,185 | 12/1974 | Daw | 299/1 |
| 4,027,210 | 5/1977 | Weber | 299/1 |
| 4,142,763 | 3/1979 | Kumaki | 299/1 |

FOREIGN PATENT DOCUMENTS

| | | | |
|---|---|---|---|
| 571605 | 9/1977 | U.S.S.R. | 299/1 |

*Primary Examiner*—William F. Pate, III

*Attorney, Agent, or Firm*—Cushman, Darby & Cushman

[57] ABSTRACT

A method of controlling the working motion of a cutting tool of a tunnel-driving machine over the breast, wherein the actual position of the cutting tool is ascertained in consideration of the position of the tunnel-driving machine relative to the desired section of the tunnel, characterized in that at least one point of reference, which is fixed in space, is aligned relative to the longitudinal axis of the tunnel, e.g., be means of a laser beam, the times of travel of signals between at least one such point of reference and two points of the tunnel-driving machine or between at least two such points of reference and at least one point of the tunnel-driving machine are measured, the measured times of travel are subsequently utilized in a trigonometric computation of the actual position of the tunnel-driving machine, and the cutting tool is adjusted to its desired position by reference to the actual position of the cutting machine.

18 Claims, 10 Drawing Figures

METHOD OF CONTROLLING THE WORKING MOTION OF A CUTTING TOOL OF A TUNNEL-DRIVING MACHINE OVER THE BREAST, AND APPARATUS FOR CARRYING OUT THE METHOD

This invention relates to a method of controlling the working motion of a cutting tool of a tunnel-driving machine over the breast, wherein the instantaneous position of the cutting tool is ascertained in consideration of the position of the tunnel-driving machine relative to the desired section of the tunnel to be driven, and to apparatus for carrying out the method.

In order to minimize the energy required to drive a tunnel, it is essential that a direction which has been selected is maintained as exactly as possible. This will be of special significance if such tunnel is driven from both ends at the same time. In such case it is essential that the breakthrough in the middle region of the tunnel is aligned as closely as possible with the tunnel portion disposed on the other side. In the driving of a tunnel, the position of the desired tunnel section is usually defined by a laser beam, which extends in the longitudinal direction of the tunnel. Because the position of the cutting tool can be ascertained in a simple manner only relative to the tunnel-driving machine, it has already been attempted to ascertain also the position of the tunnel-driving machine as exactly as possible in order to enable correcting steps which ensure that the tunnel will be cut to the desired section. Angle encoders or potentiometers, e.g., may be used to ascertain the position of a cutter arm or of the cutting tool. On the other hand, the values measured by such auxiliary instruments will indicate only the relative position of the cutting tool unless the exact position of the machine is known. To ascertain the position of the machine it has already been proposed to use a laser beam, and various apparatus have been developed for measuring deviations of the position of the machine from a straight line which is aligned with the laser beam. The performance of a laser depends on its design and on the scattering of the laser light by dust in the proximity of the machine. Another disadvantage of these embodiments resides in that the extent of any deviation of the position of the tunnel-driving machine from the desired position can be determined only with difficulty so that it is necessary to return the machine to its desired position; this is complicated.

Deviations of the actual position of a tunnel-driving machine from the desired position may be due to various movements of the tunnel-driving machine. For instance, the machine may be horizontally or vertically translated from the longitudinal axis of the tunnel or may assume positions of horizontal angular misalignment with respect to said axis or positions of vertical angular misalignment, owing to an upward or downward inclination of the machine in its direction of travel, or positions representing an angle of roll. The upward or downward inclination and the angle of roll can be ascertained in a simple manner by angle encoders (inclinometers) in a manner known per se. On the other hand, horizontal or vertical translations or angular misalignments of the tunnel-driving machine can be ascertained only by reference to a longitudinal axis of the tunnel, which axis may be defined, e.g., by a laser beam.

In view of the difficulties involved in directly aligning the tunnel-driving machine with a laser beam, it is an object of the present invention to enable the control of the working motion of a cutting tool by a method which is of the kind described first hereinbefore and by which all deviations can be reliably detected and the extent of such deviations can be exactly measured in a simple manner.

This object is accomplished according to the present invention essentially in that at least one point of reference, which is fixed in space, is aligned relative to the longitudinal axis of the tunnel, e.g., by means of a laser beam, the times of travel of signals between at least one such point of reference and two points of the tunnel-driving machine or between at least two such points of reference and at least one point of the tunnel-driving machine are measured, the measured times of travel are subsequently utilized in a trigonometric computation of the actual position of the tunnel-driving machine, and the cutting tool is adjusted to its desired position with reference to the instantaneous position of the cutting machine.

In this method, signals of any desired kind may be utilized and it will be particularly desirable to use signals which will not be disturbed by dust. The signals used in the method according to the invention will mainly consist of radar, infrared, ultrasonic or echo sounding signals, all of which can be reliably received even when light rays can no longer be detected. The measurement of the times of travel of the signal and the computation of the distances from said times of travel enable an exact trigonometric computation of the position of the tunnel-driving machine. The adjustment of the position of the cutting tool to the desired position with reference to the instantaneous position of the tunnel-driving machine does not constitute a problem from the aspects of computation and control engineering because strictly mathematically speaking this involves only a transformation of coordinates or a comparison of the space coordinates to the cutting tool and the space coordinates of the desired section of the tunnel to be driven. For this purpose it is sufficient to know the distance between two points of reference which are fixed in space or between two points of the tunnel-driving machine. When the distances from the two points fixed in space within the tunnel to one point of the tunnel-driving machine or the distances from two points of the tunnel-driving machine to one point of reference which is fixed in space within the tunnel have been measured, the two other sides of a triangle can be trigonometrically computed. It will be particularly simple to use transmitting or receiving antennas as points of reference and receiving antennas or transmitting antennas as points on the tunnel-driving machine and preferably to emit electromagnetic or sound waves from the transmitting antennas and to provide receivers for the electromagnetic or sound waves. The signals may be emitted by the several transmitting antennas in the form of pulses which are separated in time. If signals are emitted by a plurality of transmitting antennas at the same time, each transmitting antenna must emit waves at a different frequency.

Where only one point of reference which is fixed in space and two points of the tunnel-driving machine are used or one point of the tunnel-driving machine and two points of reference fixed in space within the tunnel, it is not possible to completely ascertain the position of the tunnel-driving machine by trigonometry but in that case the measured values required for a complete ascertaining of the position of the tunnel-driving machine can be ascertained by means of a gyrocompass or of inclinometers, potentiometers or angle encoders. To enable a complete ascertaining of the position of the tunnel-driving machine by trigonometry, the method is preferably carried out in such a manner that three transmitting antennas are arranged to form a triangle in a plane which is aligned relative to the longitudinal axis of the tunnel and three receiving antennas are mounted on the tunnel-driving machine and also define a plane. In this case, the method can be carried out in a simple manner in that the signals are periodically emitted and the values which have been ascertained by trigonometrical computation are stored in a buffer and are replaced from time to time by the latest corresponding values.

The apparatus according to the invention for carrying out the method is characterized in that at least one transmitter or receiver and at least two antennas are provided in the tunnel, said antennas are oriented in relation to the longitudinal axis of the tunnel, which axis is defined, e.g., by a laser, at least one receiver or transmitter provided with at least two antennas is mounted on the tunnel-driving machine, and the transmitter and receiver are connected by lines to a computer, which delivers an output signal that can be used to correct the control of the cutter arm. In conjunction with a gyrocompass, inclinometers, potentiometers or angle encoders such apparatus can completely ascertain the position of the tunnel-driving machine. By means of the apparatus according to the invention the orientation of the cutting tool is preferably ascertained by means of inclinometers, potentiometers or angle encoders, known per se, which are mounted on the tunnel-driving machine and produce signals which represent the orientation of the cutting tool relative to the tunnel-driving machine and the angle of upward or downward inclination of the longitudinal axis of the machine or its angle of roll and are also supplied by lines to the computer. In order to facilitate the correct aligning of the transmitting antennas in relation to the lingitudinal axis of the tunnel, the transmitting antennas are preferably provided with means for adjusting their position. If certain deviations of the position of the tunnel-driving machine should be permitted, the receiving antennas and, if desired, the inclinometers may be adjustable. An apparatus for a complete ascertaining of the position of the tunnel-driving machine by trigonometry is characterized in that a transmitter with three antennas disposed at the corners of a triangle is provided, the plane defined by the antennas is aligned in relation to the longitudinal axis of the tunnel, two receivers and three antennas are mounted on the tunnel-driving machine, and the antennas are selectively connected to the transmitter and the receivers.

According to the preferred further feature of the apparatus according to the invention, the computer is connected to an indicating device which indicates the actual position of the cutting tool relative to the desired section.

The indicating device used according to the invention preferably comprises two positioning belts, which extend at right angles to each other and are driven by positioning motors or stepping motors controlled by the computer, one of the positioning belts is carried along by the other transversely to the direction of movement of the former belt and provided with a scale model of the cutting tool, and a template which is provided with a scale model of the desired section is arranged in front of said position-indicating belts. In this case the arrangement may be such that the cutting tool model is provided at its contour with light sources or light-sensitive elements, such as light-emitting diodes or phototransistors, the section template is provided at its inner edge with light-sensitive elements or light sources, such as phototransistors or light-emitting diodes, and a sound signal or light signal is generated in response to the appearance of signals at the light-sensitive elements. Alternatively, two spaced apart templates may be provided, which represent the contour of the desired section, the positioning belt which carries the cutting tool model is movable between said two templates, the templates are provided at their inner edges with light sources, such as light-emitting diodes, and/or light-sensitive elements, such as phototransistors, the positioning belt which carries the cutting tool model is transparent and the cutting tool model is light-attenuating. If the indicating device is connected to an electro-hydraulic control element which cuts off the swinging drive when the contour of the cutting tool is tangent to the contour of the desired section, the sound or light signals, which can easily be overheard or overlooked, are no longer required.

The invention will now be explained with reference to the accompanying drawing, which shows additional details that are important for the invention.

Figure 1:
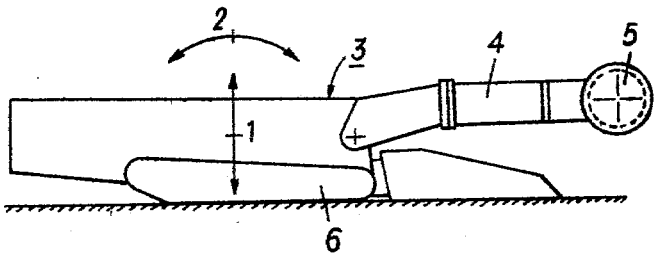
FIG. 1 is a diagrammatic side elevation showing a cutting machine.
Figure 2:
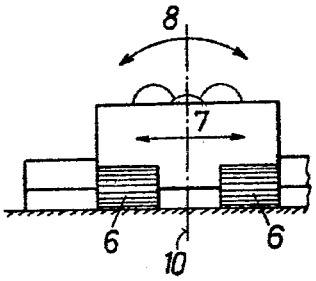
FIG. 2 is a rear elevation showing the cutting machine of FIG. 1.
Figure 3:
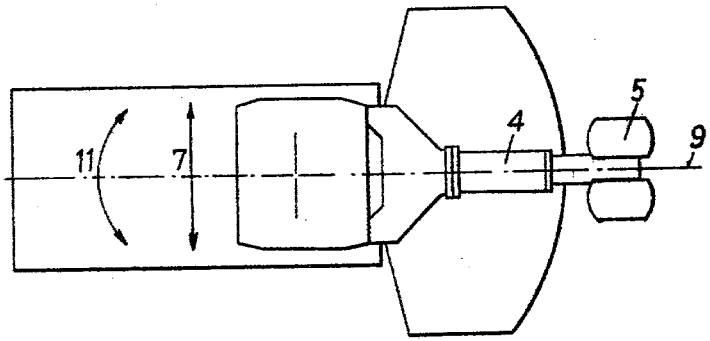
FIG. 3 is a top plan view showing the machine of FIG. 1.
Figure 4:
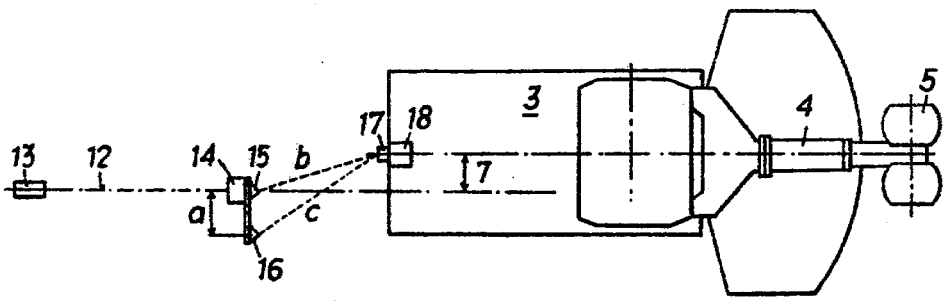
FIG. 4, 5, 6 and 7 are diagrammatic views which represent steps performed in ascertaining the position of the tunnel-driving machine.
Figure 5:
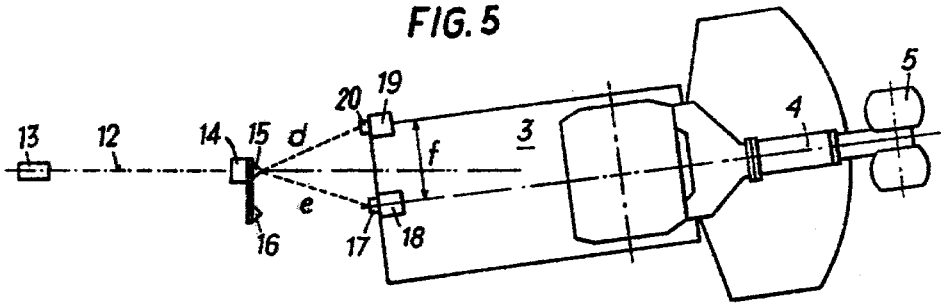

In FIG. 1 the double-headed arrow 1 indicates a vertical translation of the tunnel-driving machine. The double-headed arrow 2 indicates the angular misalignment which is due to the upward or downward inclination. The tunnel-driving machine 3 comprises a cutter arm 4 and cutting tools 5 rotatably mounted at one end of said arm. The tracklaying undercarriage of the tunnel-driving machine is designated 6. In FIG. 2 the double-headed arrow 7 indicates the horizontal translation of the tunnel-driving machine and the double-headed arrow 8 indicates the angle of roll, i.e., the rotation of the tunnel-driving machine about its longitudinal axis 9. The vertical axis 10 of the tunnel-driving machine is indicated in FIG. 2. A movement in the direction of the arrow 11 in FIG. 3 about that vertical axis results in horizontal angular misalignment of the tunnel-driving machine relative to the longitudinal axis of the tunnel. In FIG. 3 the double-headed arrow 7 again indicates the horizontal translation of the machine from the longitudinal axis of the tunnel. The method according to the invention is diagrammatically explained in FIGS. 4 to 7. FIG. 4 shows again the tunnel-driving machine 3. The longitudinal axis 12 of the tunnel is defined by a laser beam. The laser is designated 13. A transmitter 14 aligned with the longitudinal axis 12 of the tunnel comprises two transmitting antennas 15 and 16, which serve as points of reference, which are fixed in space. The distance a between these antennas is measured. The connecting line between said transmitting antennas 15 and 16 is normal to the longitudinal axis 12 of the tunnel. When a pulse is emitted by the transmitting antenna 15, the distance b from the transmitting antenna 15 to the receiving antenna 17 can be computed from the time of travel of the signal to the receiver 18. When another pulse from the same transmitter 14 is emitted by the antenna 16 and the time of travel of the signal from the transmitting antenna 16 to the receiving antenna 17 is measured, too, the distance c from the transmitting antenna 16 to the receiving antenna 17 can be computed from that time of travel. When the tunnel-driving machine is in the position shown in FIG. 4, the deviation of the position of the tunnel-driving machine 3 is due only to a horizontal translation 7. The computation of the triangle having the sides a, b and c by trigonometry will not completely indicate the exact position of the tunnel-driving machine because this computation does not indicate whether or not there is such an angular misalignment of the tunnel-driving machine that there are the same distances b and c between the transmitting antennas 15 and 16 and the receiving antenna 17. The link between the transmitter and the computer and the link between the receiver and the computer are not shown in FIG. 4 but are required for a synchronization of the measurements of the times of travel. These links may consist of a signal line or a radio link. Depending on the nature of said link, it is used either to transmit the trigger pulse or the result of measurement.

FIG. 5 shows again the tunnel-driving machine 3, the laser 13 and the longitudinal axis 12 of the tunnel, also the transmitter 14 and the transmitting antennas 15 and 16, which are aligned in relation to the longitudinal axis 12 of the tunnel. For taking the measurement represented in FIG. 5, a pulse is emitted only by the transmitting antenna 15 and is received by two receivers 18 and 19 mounted on the tunnel-driving machine 3. The receiving antenna of the receiver 18 is again designated 17 and the receiving antenna of the receiver 19 is designated 20. A distance d can be computed from the time of travel of the signal from the transmitting antenna 15 to the receiving antenna 20. A distance e is ascertained from the time of travel of the signal from the transmitting antenna 15 to the receiving antenna 17. The distance f between the receiving antennas 17 and 19 can be ascertained in a simple manner. The orientation of the connecting line between the receiving antennas 17 and 20 relative to the tunnel-driving machine 3 is known. The triangle defined by the transmitting antenna 15 and the receiving antennas 17, 20 can be determined from its sides d, e and f and all angles can be ascertained. The result of this computation indicates a translation as well as an angular misalignment. If one of the two deviations is known from a previous measurement, for instance the translation from a trigonometric measurement or the angular misalignment from a gyrocompass, the respective other deviation can be computed from said measured values. In this case the measurement is effected by a transmission of a pulse to both receivers.

Figure 6:
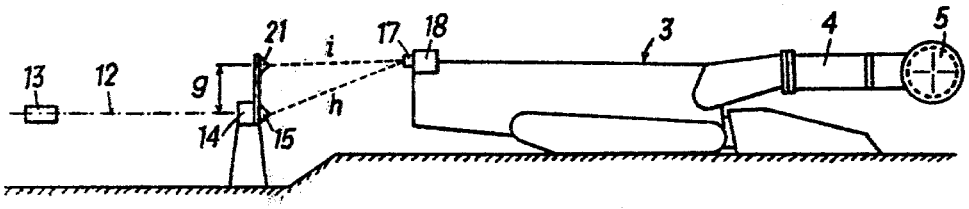

FIG. 6 also shows a laser 13 and the longitudinal axis 12 of the tunnel. In addition to its transmitting antenna 15, the transmitter 14 is provided with another transmitting antenna 21 and the distance g between the transmitting antennas 15 and 21 can be measured. The spatial orientation of the transmitting antenna 21 is also adjustable by suitable adjusting means. In order to simplify the computation, a right angle to the longitudinal axis of the tunnel is again selected. The connecting line between the transmitting antennas 15 and 21 is vertical. The tunnel-driving machine 3 is provided with the receiver 18 and the receiving antenna 17. If the transmitting antennas 25 and 21 emit signals which are separated in time, the times of travel of these signals from the transmitting antenna 15 to the receiving antenna 17 and from the transmitting antenna 21 to the receiving antenna 17 can be ascertained. These times of travel indicate the distance h from the transmitting antenna 15 to the receiving antenna 17 and the distance i from the transmitting antenna 21 to the receiving antenna 17. The vertical translation can be derived from the triangle which has the sides g, h and i and which is computed by trigonometry.

Figure 7:
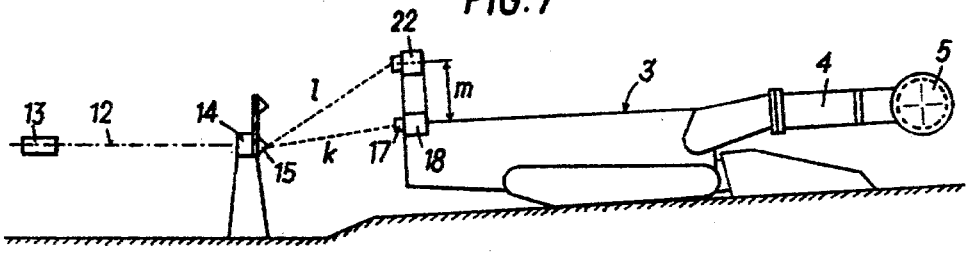

As has been mentioned hereinbefore, the upward or downward inclination of the tunnel-driving machine is suitably ascertained in known manner by means of an inclinometer. As is shown in FIG. 7 the angle of upward or downward inclination of the machine and the vertical translation can be jointly ascertained by a trigonometric measurement if another receiving antenna 22 is mounted on the tunnel-driving machine 3. FIG. 7 shows also the laser 13 and the longitudinal axis 12 of the tunnel. For the measurement which is diagrammatically shown in FIG. 7, a pulse emitted by the transmitting antenna 15 can be received by the receiving antennas 22 and 17. The receiving antenna 22 may be connected to a separate receiver, not shown, or to the same receiver 18 as the antenna 17. This distance between the receiving antennas 17 and 22 and the spatial orientation of these receiving antennas 17 and 22 relative to the tunnel-driving machine 3 can be determined in a simple manner. The distance k from the transmitting antenna 15 to the receiving antenna 17 and the distance l from the transmitting antenna 15 to the receiving antenna 22 again depend on the times of travel of the signals from the transmitting antenna 15 to the receiving antennas 17 and 22. In conjunction with the known distance m between the receiving antennas 17 and 22, the triangle having the sides k, l, and m can now be solved by trigonometry. If the vertical translation or the upward or downward inclination is known, that computation may be used to ascertain the respective other deviation. The two distances k and l are preferably measured in that one pulse is received by two receiving antennas 17 and 22. The receiving antenna 22 may be connected to a separate receiver, which is not shown, or to the receiver 18. In the latter case the circuitry must be such that the time of travel between the transmitting antenna 15 and the antenna 17 is distinguished from the time of travel between the transmitting antenna 15 and the receiving antenna 22.

The measurements diagrammatically explained in FIGS. 4 to 7 may be connected in any desired sequence. If a gyrocompass has been oriented along the longitudinal axis of the tunnel and generates analog signals representating an angular misalignment of the tunnel-driving machine about a vertical axis and these signals are also taken into account, a fewer number of measurements will be required for a complete determination of the position of the machine.

The distance from the tunnel-driving machine to the transmitters disposed behind said machine is not significant for the principle of measurement but the measurement will be less accurate if said distance is large. For this reason the transmitters must be at certain intervals of time relocated in the direction in which the tunnel is driven, which intervals depend on the rate of advance of the machine, and after each relocation the transmitters must be adjusted with respect to the laser beam. The lines by which the transmitter is connected to the machine, the transmitter is connected to the computer and the machine is connected to the computer remain the same and must be so long that they do not restrict the movements of the machine.

The trigonometric measurements are usually conducted in a uniform cyclic sequence. The latest values which have been measured and computed are stored instead of those which were stored last and are read from storage in certain intervals of time by the computer for further processing.

The position of the cutting tool relative to the frame of the tunnel-driving machine can be ascertained by a measurement of two angles. The angular misalignments in the horizontal and vertical directions can be measured, e.g., by inductive angle transducers, capacitive angle transducers, electro-optical angle encoders or resistance transducers (pontiometers). Each of these transducers will present at its output a digital signal (pulse or code word) or an analog signal (current or voltage), which is transmitted to the computer. From the signals which are proportional to angles, the computer determines the coordinates of the cutting tool in the coordinate system of the machine. That system is rigid with respect to the machine frame.

The computer is preferably installed on the machine and can now serve the following functions:

1. Evaluation of the measurements in accordance with the methods explained in FIGS. 4 to 7 and calculation of the deviations from said measurements. That evaluation may also be effected by a separate transducer circuit, which produces analog or digital signals which represent the deviation and are processed further in the computer.
2. Computation of the position and/or deviation of the cutting tool in the coordinate system of the machine.
3. When the deviations of the machine position have been computed and the goniometers have been read or the measured values have been read from storage, the computer in consideration of the geometry and deviation of the machine can compute the position and deviation of the cutting tool in the coordinate system of the tunnel. In doing so the computer takes into account that deviations of the machine exert different influences on the cutting tool in dependence on the instantaneous position of the cutter arm.
4. Transformation of coordinates between the two systems. The deviations of the cutting tool, which depend on the working motion of the swinging arm and are defined by coordinates of the coordinate system of the machine, are transformed by the computer into coordinates of the coordinate system of the tunnel in consideration of the instantaneous deviation of the machine (corresponding to a translation and rotation of the system of coordinates) and the computer produces a signal which is proportional to the deviation of the cutter head in coordinates of the coordinate system of the tunnel. This system can be used to control the indicating device.

Figure 8:
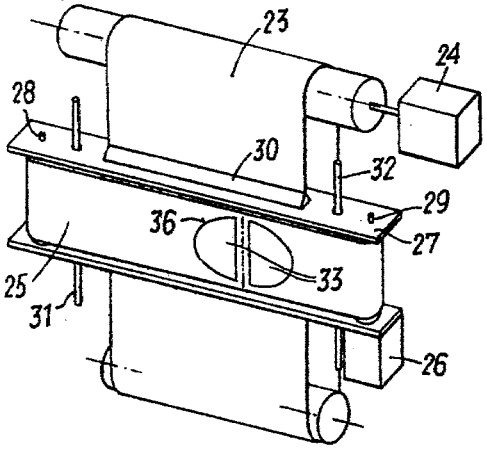
FIG. 8 is a perspective view showing the indicating device when the section template has been removed.
Figure 9:
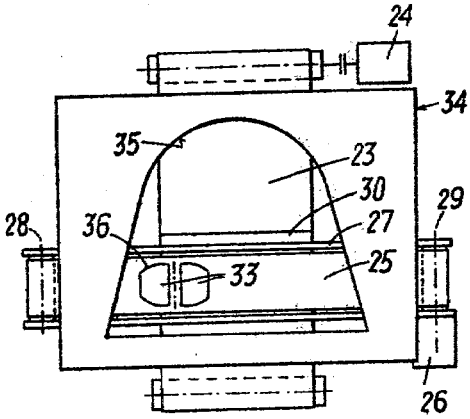
FIG. 9 is a front elevation showing the indicating device according to the invention and FIG. 10 is a sectional view in the plane which is transverse to the section templates of another embodiment of the indicating device.

The indicating device used for this purpose is diagrammatically shown in FIGS. 8 and 9.

In FIG. 8, the template which carries the desired section has been omitted for the sake of clearness. A positioning belt 23 is provided, which is movable in a vertical direction and driven by a positioning motor 24. A horizontal positioning belt 25 is associated with the vertical positioning belt 23 and driven by a positioning motor 26. The axles 28 and 29 for reversing the horizontal positioning belt 25 are mounted on a carrier 27, which is rigidly connected at 30 with the vertical positioning belt 23. The positioning motor 26 for the horizontal positioning belt is also rigidly secured to the carrier 27. Guide rods 31, 32 are provided for guiding the horizontal positioning belt 25. The horizontal positioning belt 25 carries cutting tool model 33. The motor 24 for driving the vertical positioning belt 23 is controlled to move the horizontal positioning belt and the scale model 33 of the cutting tool in the vertical direction. The positioning motor 26 moves the model 33 of the cutting tool in a lateral direction.

The same reference characters as in FIG. 8 are used also in FIG. 9, which shows also the template 34, the inner edge 35 of which is a scale model of the desired section.

The entire indicating device can be accommodated simply in a dust-tight housing, not shown. The front cover of said housing must be transparent.

If light-emitting diodes are provided at the edge 36 of the cutting tool model 33 and phototransistors are provided at the edge 35 of the template 34, the phototransistors at the edge 35 of the template 34 will generate a signal when the light emitted by the light-emitting diodes at the edge 36 of the cutting tool model 33 is incident on the phototransistors. This signal indicates that the cutting tool is tangent to the contour of the descired section. In response to such signal, the operator of the tunnel-driving machine can make suitable corrections in the control of the cutting tool. The signal may also be used in a simple manner to cut off by means of an electrohydraulic control element the drive means for swinging the cutting tool.

Depending on its design, the indicating device may serve various functions. For instance, the indicating device may be used to indicate only the position of the cutting tool. In that case the swinging arm may be perfectly unrestrained and may be movable under the control of the operator of the machine also outside the contour of the desired section. If the indicating device is provided with light-emitting diodes and phototransistors, it may be used to generate a light or sound signal as soon as the edge of the cutting tool reaches or begins to move beyond the contour of the desired section.

The positioning belts may be controlled by continuously operating positioning motors and potentiometers or angle encoders or by means of stepping motors.

An embodiment which is not shown comprises two spaced apart templates which represent the desired section. In this case the inner edge of these templates represents the contour of the desired section and may be provided with optical fibers, light-emitting diodes and/or phototransistors and the positioning belts are transparent. These templates may then be so arranged that one template is disposed in front of the positioning belt which carries the cutting tool model and the other template is disposed behind said positioning belt. If the cutting tool model is capable of attenuating light, the signal generated by the phototransistors will be changed as soon as the contour of the cutting tool model enters the light path between the inner edges of the templates. In that case such change of the signal of the phototransistors is utilized to initiate the sound or light signals or for cutting off the drive means for the cutting tool.

The templates formed with the desired section may be replaced in a simple manner so that different scale models of sections to be cut can be used. The template may have an aperture which represents the section to be cut or the template may have a higher light transmittance outside the contour of the scale section than within said contour.

Figure 10:
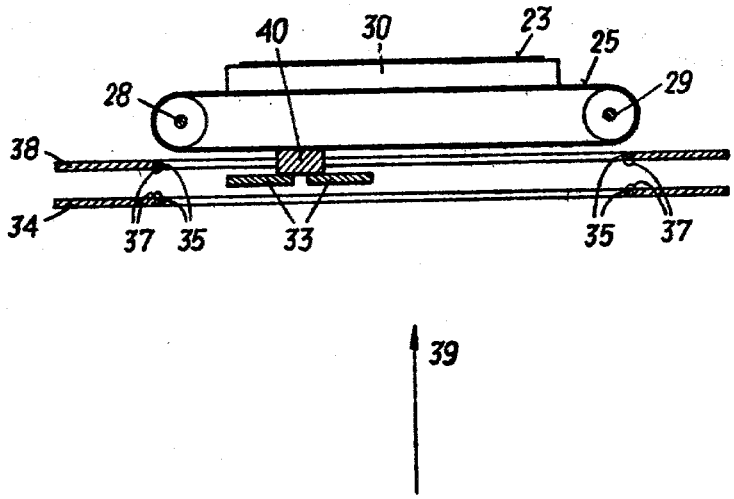

FIG. 10 shows also a vertical positioning belts 23 and a horizontal positioning belt 25, which carries the cutting tool model 33. The indicating device also comprises section templates 34 and 38, which in a top plan view, indicated by the arrow 39, appear one behind the other. The edges 35 of these section templates are provided with photodiodes or phototransistors 37. Each photodiode on the template 34 is aligned in the direction of the arrow 39 with a phototransistor on the template 38. The cutting tool model 33 is fixed to the positioning belt 25 and spaced therefrom by such a distance that the model is moved between the two templates 34 and 38. If the cutting tool model 33 enters the light path between the photodiodes and phototransistors 37 of the templates 34 and 38, the light path will be interrupted and a signal will be generated or a control pulse for triggering a device for cutting off the means for driving the cutter arm. In this case the positioning belt which carries the cutting tool model need not be transparent. The cutting tool model may be secured to the positioning belt simply by a spacer 40, which extends through the aperture of one of the two section templates, in this case the section template 38.

The means for positioning the cutting tool model may consist in a simple manner of a screw mechanism rather than of the positioning belts which have been shown.

What we claim is:

1. A method of controlling the working motion of a cutting tool of a tunnel-driving machine over the breast, wherein the actual position of the cutting tool is ascertained in consideration of the position of the tunnel-driving machine relative to the desired section of the tunnel, characterized in that at least one point of reference, which is fixed in space, is aligned relative to the longitudinal axis of the tunnel by means of a laser beam, the times of travel of signals between at least one such point of reference and two points of the tunnel-driving machine or between at least two such points of reference and at least one point of the tunnel-driving machine are measured, the measured times of travel are subsequently utilized in a trigonometric computation of the actual position of the tunnel-driving machine, and the cutting tool is adjusted to its desired position by reference to the actual position of the cutting machine.

2. A method according to claim 1, characterized in that transmitting antennas or receiving antennas are used as points of reference and receiving antennas or transmitting antennas are used as points on the tunnel-driving machine, the transmitting antennas emitting electromagnetic or sound waves and the receivers being capable of receiving the electromagnetic or sound waves.

3. Apparatus for controlling the working motion of a cutting tool of a tunnel-driving machine located in a tunnel, characterized in that at least one transmitter or receiver and at least two antennas are provided in the tunnel, said antennas being oriented in relation to the longitudinal axis of the tunnel, which axis is defined by a laser, at least one receiver or transmitter provided with at least two antennas being mounted on the tunnel-driving machine, computer and lines connecting the transmitter and receiver to the computer, which delivers an output signal that can be used to correct the control of the cutter arm.

4. Apparatus according to claim 3, characterized in that inclinometers, potentiometers or angle encoders, known per se, are mounted on the tunnel-driving machine and produce signals which represent the orientation of the cutting tool in relation to the tunnel-driving machine and, if desired, the angle of upward or downward inclination or the angle of roll of the tunnel-driving machine and are also fed via lines to the computer.

5. Apparatus according to claim 3 or 4, characterized in that the transmitting antennas are provided with means for adjusting their position.

6. Apparatus according to claim 3, characterized in that the receiving antennas and, if desired, the inclinometers are adjustable.

7. Apparatus according to claim 3, characterized in that the computer is connected to an indicating device which indicates the instantaneous position of the cutting tool relative to the desired section.

8. In a method of controlling the working motion of a movable cutting tool of a tunnel-driving machine the steps of establishing at least two points of reference fixed in space within the tunnel and aligned relative to the longitudinal axis of the tunnel; establishing two fixed points on the machine; transmitting sound wave or electromagnetic signals between at least one reference point and two machine points or between at least two reference points and at least one machine point and measuring the times of travel of said signals; trigonometrically computing from the times of travel the distances travelled by said signals and hence the position of the tunnel-driving machine; and adjusting the position of the cutting tool in accordance with the position of the tunnel-driving machine.

9. In a tunnel-drving machine having a movable cutter arm carrying a cutting tool and having drive means for adjusting the position of the arm, apparatus for controlling the motion of the arm comprising: a signal generating device in the tunnel for generating a signal beam which defines the longitudinal axis of the tunnel; a first device having at least two antennas located in the tunnel and oriented in relation to the signal beam which defines the longitudinal axis of the tunnel; a second device having at least two second antennas mounted on said tunnel-driving machine, said first device being a signal transmitter when said second device is a signal receiver and being a signal receiver when said second device is a signal transmitter; and a computer connected to said first and second devices for generating an output signal for use in controlling the drive means for the cutter arm.

10. A method of controlling the working motion of a cutting tool of a tunnel-driving machine over the breast, wherein the actual position of the cutting tool is ascertained in consideration of the position of the tunnel-driving machine relative to the desired section of the tunnel, characterized in that transmitting antennas or receiving antennas are used as points of reference and receiving antennas or transmitting antennas are used as points on the tunnel-driving machine and in that the transmitting antennas emit signals consisting of pulses and different transmitting antennas emit signals in the form of pulses which are separated in time, further characterized in that at least one point of reference, which is fixed in space, is aligned relative to the longitudinal axis of the tunnel, the times of travel of signals between at least one such point of reference and two points of the tunnel-driving machine or between at least two such points of reference and at least one point of the tunnel-driving machine are measured, the measured times of travel are subsequently utilized in a trigonometric computation of the actual position of the tunnel-driving machine, and the cutting tool is adjusted to its desired position by reference to the actual position of the cutting machine.

11. A method of controlling the working motion of a cutting tool of a tunnel-driving machine over the breast, wherein the actual position of the cutting tool is ascertained in consideration of the position of the tunnel-driving machine relative to the desired section of the tunnel, characterized in that transmitting antennas or receiving antennas are used as points of reference and receiving antennas or transmitting antennas are used as points on the tunnel-driving machine and in that signals are emitted by a plurality of transmitting antennas at the same time and each transmitting antenna emits signals at a different frequency, further characterized in that at least one point of reference, which is fixed in space, is aligned relative to the longitudinal axis of the tunnel, the times of travel of signals between at least one such point of reference and two points of the tunnel-driving machine or between at least two such points of reference and at least one point of the tunnel-driving machine are measured, the measured times of travel are subsequently utilized in a trigonometric computation of the actual position of the tunnel-driving machine, and the cutting tool is adjusted to its desired position by reference to the actual position of the cutting machine.

12. A method of controlling the working motion of a cutting tool of a tunnel-driving machine over the breast, wherein the actual position of the cutting tool is ascertained in consideration of the position of the tunnel-driving machine relative to the desired section of the tunnel, characterized in that these signal-transmitting antennas are arranged to form a triangle in a plane which is aligned relative to the longitudinal axis of the tunnel and three signal-receiving antennas are mounted on the tunnel-driving machine and also define a plane and further characterized in that the times of travel of signals between at least one such point of reference and two points of the tunnel-driving machine or between at least two such points of reference and at least one point of the tunnel-driving machine are measured, the measured times of travel are subsequently utilized in a trigonometric computation of the actual position of the tunnel-driving machine, and the cutting tool is adjusted to its desired position by reference to the actual position of the cutting machine.

13. A method of controlling the working motion of a cutting tool of a tunnel-driving machine over the breast, wherein the actual position of the cutting tool is ascertained in consideration of the position of the tunnel-driving machine relative to the desired section of the tunnel, characterized in that signal-transmitting antennas or signal receiving antennas are used as points of reference and signal-receiving antennas or signal-transmitting antennas are used as points on the tunnel-driving machine and in that the signals are emitted periodically and the values which have been ascertained by trigonometric computation are stored in a buffer and are replaced from time to time by the latest corresponding values, further characterized in that at least one point of reference, which is fixed in space, is aligned relative to the longitudinal axis of the tunnel, the times of travel of signals between at least one such point of reference and two points of the tunnel-driving machine or between at least two such points of reference and at least one point of the tunnel-driving machine are measured, the measured times of travel are subsequently utilized in a trigonometric computation of the actual position of the tunnel-driving machine, and the cutting tool is adjusted to its desired position by reference to the actual position of the cutting machine.

14. Apparatus for controlling the working motion of a cutting tool of a tunnel-driving machine located in a tunnel characterized in that a transmitter with three antennas disposed at the corners of a triangle is provided in the tunnel, the plane defined by said antennas being oriented in relation to the longitudinal axis of the tunnel, two receivers with three antennas mounted on the tunnel-driving machine, said antennas being selectively connected to the transmitter and to the receivers, a computer and lines connecting the transmitter and receiver to the computer, which delivers an output signal that can be used to correct the control of the cutter arm.

15. Apparatus for controlling the working motion of a cutting tool of a tunnel-driving machine located in a tunnel characterized in that at least one transmitter or receiver and at least two antennas are provided in the tunnel, said antennas being oriented in relation to the longitudinal axis of the tunnel, at least one receiver or transmitter provided with at least two antennas being mounted on the tunnel-driving machine, a computer and lines connecting the transmitter and receiver to the computer, which delivers an output signal that can be used to correct the control of the cutter arm, said computer being connected to an indicating device which indicates the instantaneous position of the cutting tool relative to the desired section, said indicating device comprising two positioning belts or positioning screw spindles, which extend at right angles to each other and are adapted to be driven by positioning or stepping motors controlled by the computer, one of the positioning belts or positioning spindles being carried along by the other positioning belt or spindle transversely to the direction of movement of the former belt or spindle and provided with a scale model of the cutting tool, and a template which is provided with a scale model of the desired section disposed in front of said positioning belts or screw spindles.

16. Apparatus according to claim 15, characterized in that the cutting tool model is provided at its contour with light sources or light-sensitive elements, such as light-emitting diodes or phototransistors, the section template is provided at its inner edge with light-sensitive elements or light sources, such as phototransistors or light-emitting diodes, and a sound or light signal is initiated in response to the appearance of signals at the light-sensitive elements.

17. Apparatus according to claim 16, characterized in that two spaced apart templates are provided, which represent the contour of the desired section, the model of the cutting tool is light-attenuating and is movable between the two templates, and the templates are provided at their inner edge with light sources, such as light-emitting diodes, and/or light-sensitive elements, such as phototransistors.

18. Apparatus for controlling the working motion of a cutting tool of a tunnel-driving machine located in a tunnel characterized in that at least one transmitter or receiver and at least two antennas are provided in the tunnel, said antennas being oriented in relation to the longitudinal axis of the tunnel, at least one receiver or transmitter provided with at least two antennas being mounted on the tunnel-driving machine, a computer and lines connecting the transmitter and receiver to the computer, which delivers an output signal that can be used to correct the control of the cutter arm, said computer being connected to an indicating device which indicates the instantaneous position of the cutting tool relative to the desired section, and said indicating device being connected to an electrohydraulic control element for cutting off the swinging drive when the contour of the cutting tool is tangent to the contour of the desired section.

* * * * *